United States Patent [19]

Battaglin

[11] Patent Number: 4,829,886

[45] Date of Patent: May 16, 1989

[54] CENTRAL HEATING SYSTEM VENT GUARD

[75] Inventor: George Battaglin, Concord, Canada

[73] Assignee: Bolt-Krete Industries Inc., Concord, Canada

[21] Appl. No.: 179,552

[22] Filed: Apr. 8, 1988

[51] Int. Cl.[4] ..... F24F 13/062

[52] U.S. Cl. ..... 98/103; 98/105; 98/114

[58] Field of Search ..... 98/101, 103, 105, 108, 98/114, 40.01, 122; 138/96 R

[56] References Cited

U.S. PATENT DOCUMENTS

| | | | |
|---|---|---|---|
| 966,842 | 8/1910 | Lewis | 98/105 |
| 1,739,372 | 12/1929 | Pirchio | 98/103 |
| 2,719,476 | 10/1955 | Duvolis | 98/108 |
| 3,469,520 | 9/1969 | Fuy et al. | 98/122 |
| 4,338,859 | 7/1982 | Claytor | 98/105 |

FOREIGN PATENT DOCUMENTS

| | | | |
|---|---|---|---|
| 730634 | 10/1932 | France | 98/101 |

*Primary Examiner*—Harold Joyce
*Attorney, Agent, or Firm*—Ivor M. Hughes

[57] ABSTRACT

Guard mechanism comprising a top and bottom having disposed within the top thereof and extending towards the bottom thereof at least one recess, the at least one recess having side walls extending from proximate the top to proximate the bottom of the guard mechanism, the side walls abutting at least one lateral flange proximate the top of the guard mechanism, each lateral flange extending laterally away from the at least one recess proximate the top of the guard mechanism, some of the side walls having disposed therein at least one channel apparatus, each channel apparatus extending from the bottom of the guard mechanism to proximate the top of the guard mechanism and thereat each channel continuing along the extension of a complimentary adjoining laterally extending flange whereat the channel terminates remote the recess; wherein when the guard mechanism is inserted within an inlet or outlet of a ducting system, any contaminants will be prevented from entering said system, but the circulation of air or alternative gasses will be allowed through the channel apparatus disposed within the side walls and flanges of the guard mechanism.

7 Claims, 5 Drawing Sheets

" PRIOR ART "

CENTRAL HEATING SYSTEM VENT GUARD

FIELD OF INVENTION

This invention relates to a guard or trap device placed within the boot of a central heating system duct as a trap or a guard preventing contaminants from entering the duct work of the heating system.

BACKGROUND OF THE INVENTION

Within the housing industry there exists a problem of contamination of a central heating duct system by contractors fabricating each house using the duct work as garbage bins. Further, in an unfinished home, water, coffee cups and other contaminants may enter the heating system resulting in costly removal procedures involving disassembly of the duct work at times in order to prepare the home for the occupants. Once occupied further a ducting system may have to be vacuumed or disassembled to extract the contaminants therein.

In order to avoid the afore-mentioned problem, boards have been placed over the central duct work and specifically at the boots therefor to prevent the contamination of the duct work. However, the boards represent tripping hazards and must be removed when any finishing work is being done on the floors of the house. In the winter time it has also been found to be advantageous to keep the house at a predetermined temperature to avoid any complications that the lower temperatures create in building a home as is well known in the art.

Nowhere within the prior art is there found a guard or trap device which is placed within the boot of a central heating system and specifically in the duct work thereof, said guard or trap device preventing any contamination such as water or dry waste from entering the ducting, yet allowing for the passage of heated circulating air to maintain the house at said predetermined temperature.

Applicant is aware of registered trade mark HUMIREG, a registered trade mark of Pure Air Products Limited of Surrey, British Columbia, Canada, which comprises an insert placed within the boot of a ducting system within a house, for example, used as a container for water and allowing the circulating air to pass through an opening disposed through the center of the device which will heat the water contained in the bicameral chambers of the insert and evaporated to the environment of the house. However, the afore-mentioned device does not prevent contaminants from entering the duct system and is specifically used as a humidifying device.

It is therefore an objection of this invention to provide a unique guard or trap device used within duct work for preventing contaminants or liquids from entering the duct work yet allowing the passage of heated air for circulation within the environment housing the duct work.

It is a further object of this invention to provide a guard or trap device which is economical to use and manufacture.

Further and other objects of the invention will become apparent to man skilled in the art when considering the following summary of the invention and the more detailed description of the preferred embodiments illustrated herein.

SUMMARY OF THE INVENTION

According to one aspect of the invention, there is provided guard means for insertion within an outlet or inlet of a duct system, said guard means comprising a top and bottom having disposed within the top thereof and extending towards the bottom thereof at least one recess, said at least one recess having side walls extending from proximate the top to proximate the bottom of the guard means, said side walls abutting at least one lateral flange proximate the top of said guard means, each lateral flange extending laterally away from the at least one recess proximate the top of said guard means, some of said side walls having disposed therein at least one channel means, each channel means extending from the bottom of said guard means to proximate the top of said guard means and thereat each channel continuing along the extension of a complimentary adjoining laterally extending flange whereat said channel terminates remote said recess; wherein when said guard means is inserted within an inlet or outlet of a ducting system, any contaminants will be prevented from entering said system, but the circulation of air or alternative gasses will be allowed through said channel means disposed within the side walls and flanges of said guard means.

According to yet another aspect of the invention, there is provided guard means for use within a central heating system duct work of a house, said guard means comprising a top and bottom and being of substantially rectangular form, said guard means having disposed within the top thereof at least one recess extending from proximate the top of said guard means to proximate the bottom of said guard means, said recess having disposed therein about the perimeter thereof side walls, each side wall extending from proximate the top to proximate the bottom of said guard means, said at least one recess having disposed at the top thereof and extending laterally away therefrom at least one flange, said flange and its complimentary abutting side wall having disposed about the extremity thereof remote said recess, channel means extending from the bottom of said guard means at some of the sides thereof toward the top of said guard means, said channel then extending along the extension of each complimentary abutting flange and terminating approximate the end of each appropriate flange remote said recess, wherein when said guard means is inserted within the duct work of a central heating system, said guard means prevents the passage of contaminants or moisture to said duct system yet allowing the heated air to pass through the channel means to the environment of the house being heated.

According to another aspect of the invention, the side walls of the guard means may comprise tapered side walls tapering from proximate the top of said guard means towards one another proximate the bottom of said guard means.

According to yet another aspect of the invention, the guard means may be formed from a singular sheet of thermoplastic material by conventional moulding techniques.

DETAILED DESCRIPTION OF PREFERRED EMBODIMENTS OF THE INVENTION

Figure 1:
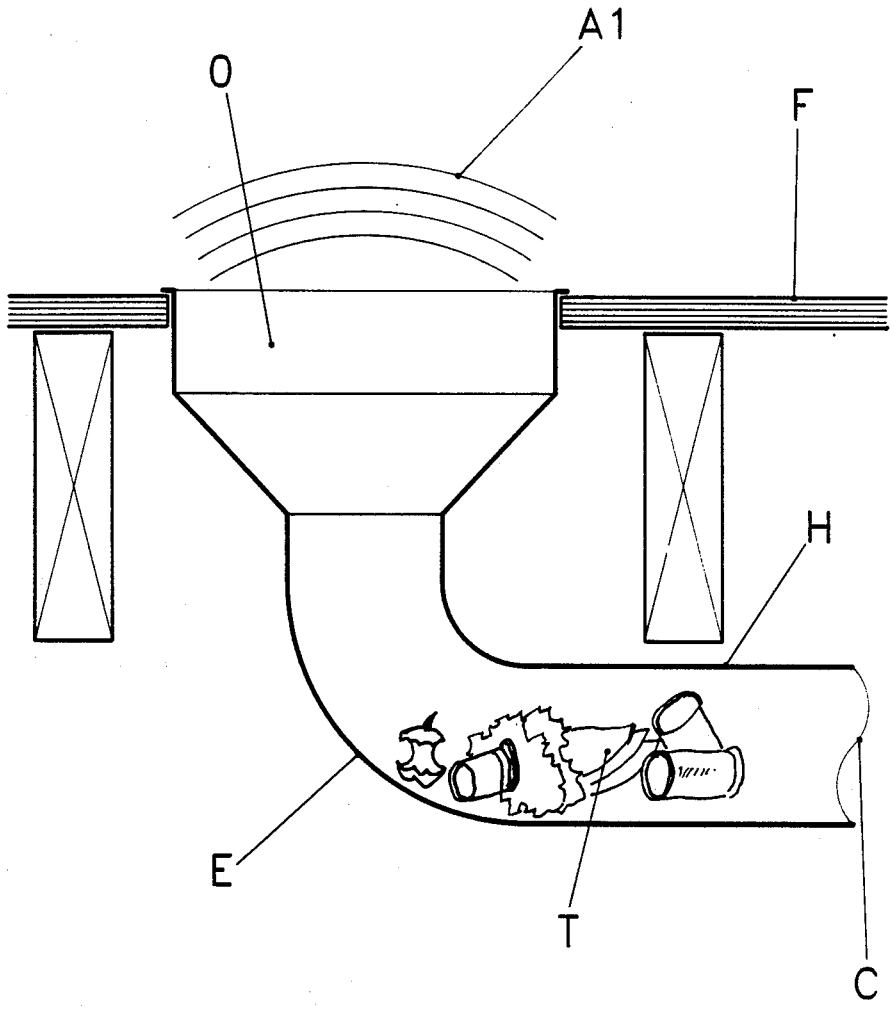
FIG. 1 is a cross-sectional view of a duct used in a typical house having a forced-air heating system wherein trash and debris are collected within the horizontal run of the ducting system.

Referring now to FIG. 1, there is illustrated a typical cross-section of a heating duct found within a house having a forced-air heating system. Thus is disposed within floor F a boot B wherein a horizontal run H is connected to said boot by a elbow E of a central ducting system C. Air $A_1$ passes through said central ducting system, to the environment being heated.

Typically the view of FIG. 1 is found during the construction of a house where heat is required to maintain the temperature of the house at a predetermined level through the winter months yet an opening O exists within the floor vent duct through which both moisture and other contaminants "T" may pass collecting in the horizontal run of the duct work as illustrated in FIG. 1. As a result of such collection of dry or wet contaminants, the heating system may be permanently fouled. Extremely costly procedures may be required to defoul the system once the occupants purchase the house. Simple techniques such as vacuuming out the duct work from each boot may satisfy the problem and the occupants of the house. However, at times it is necessary to disassemble the entire duct system in order to ensure that complete defouling is accomplished. In order to avoid the fouling of said duct work of the central heating system, the instant invention provides for a guard device as illustrated in FIG. 1A.

Figure 1A:
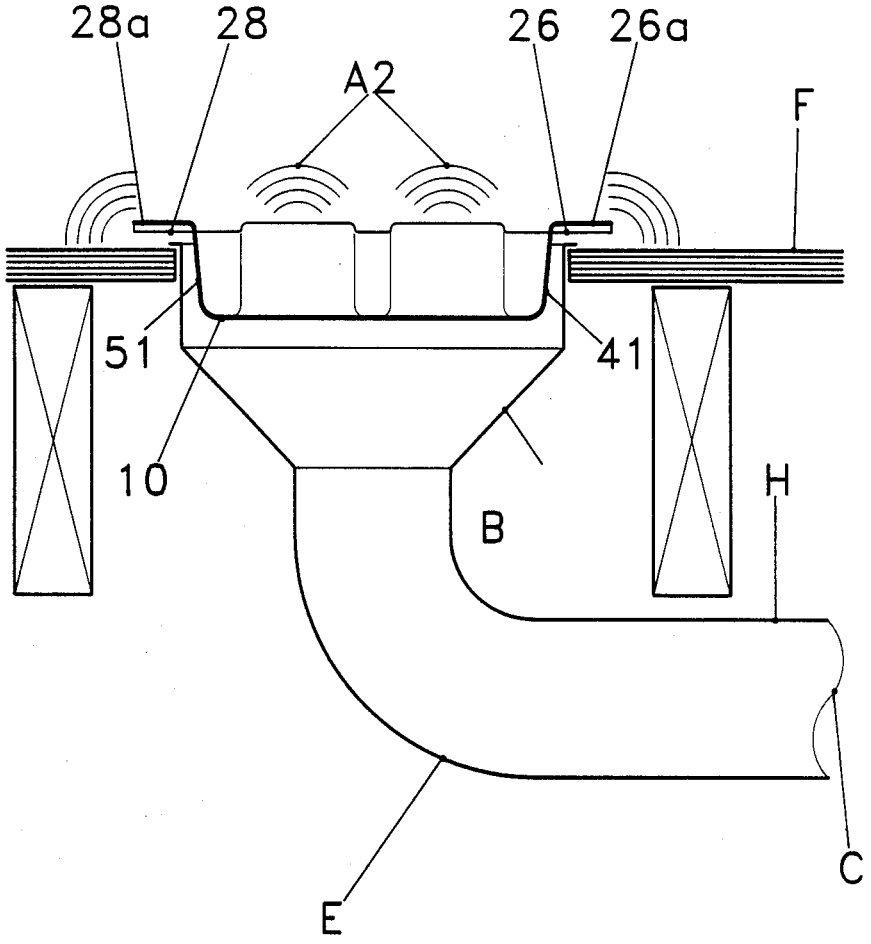
FIG. 1A is a cross-sectional view of the guard device inserted within the boot of a duct within the central heating system of a house in a preferred embodiment of the invention.

Referring now to FIG. 1A, there is illustrated the duct work of FIG. 1 wherein prior to contaminants "T" passing into the duct work, the guard device of the instant invention is inserted within the boot B which acts as a trap to prevent contaminants from collecting within the horizontal run H of central heating duct C. Thus, the absence of trash T is noted. Thus, in FIG. 1A is illustrated the guard device 10 inserted within the boot B of the central system C having a horizontal run H and an elbow E wherein channels 51, 28*a* and 26*a* and 41 are disposed within the perimeter of the guard device to allow the passage of air $A_2$ therethrough and to the environment being heated. Guard 10 rests firmly within the floor F by flanges 26 and 28.

Figure 2:
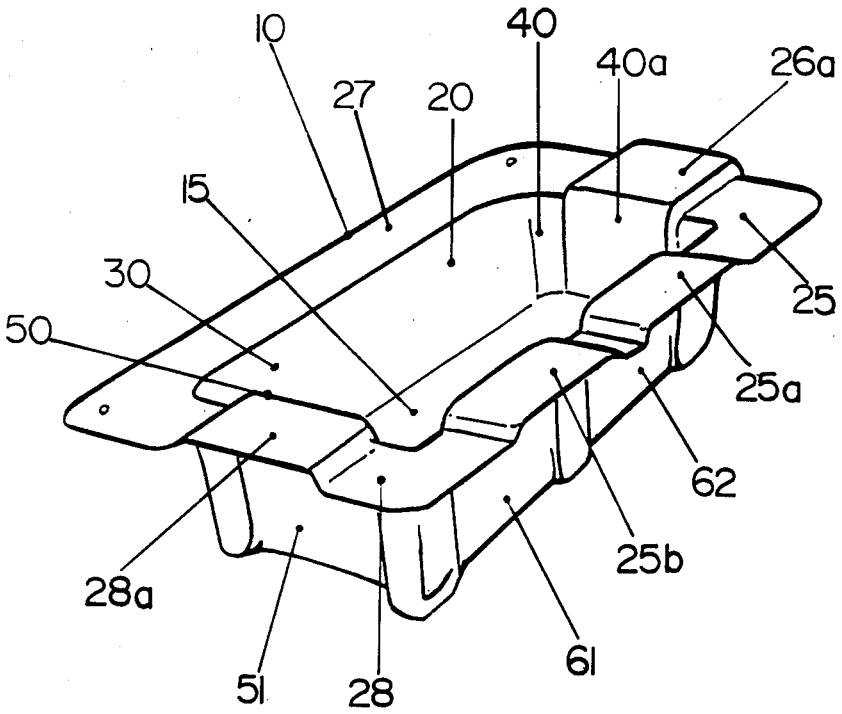
FIG. 2 is a perspective view of the guard device in a preferred embodiment of the invention being molded from one singular sheet of thermoplastic material.
Figure 3:
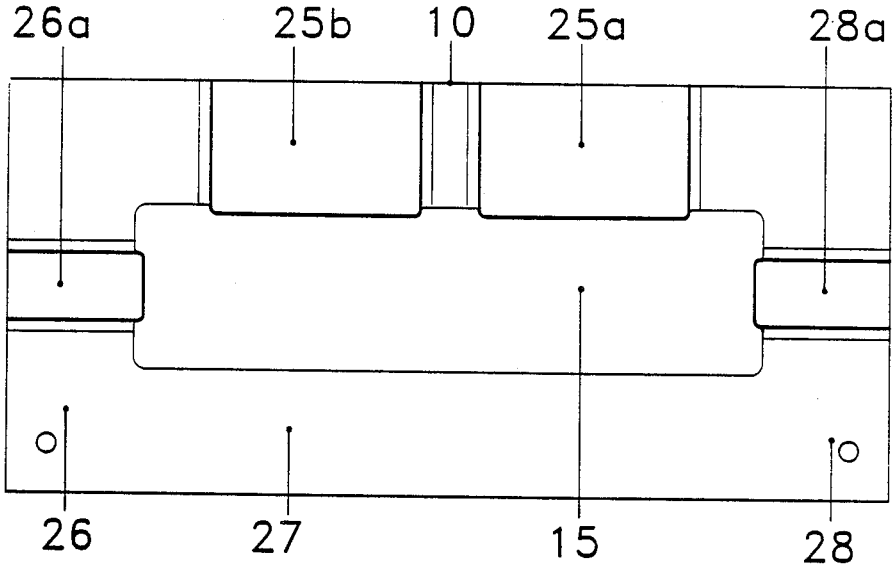
FIG. 3 is a top view of the perspective view of FIG. 2 in a preferred embodiment of the invention.
Figure 4:
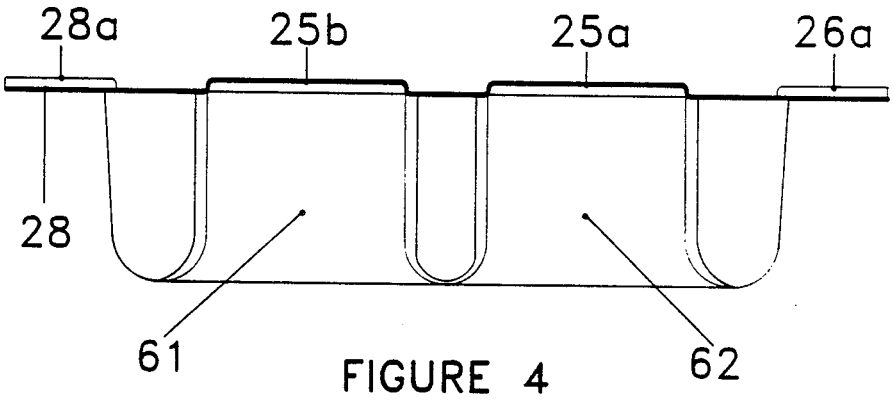
FIG. 4 is a side view of the guard device of FIG. 2 in a preferred embodiment of the invention.
Figure 5:
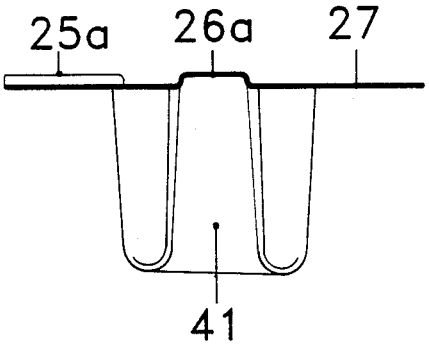
FIG. 5 is a front view of the guard device of FIG. 2 in a preferred embodiment of the invention.

Referring now to FIGS. 2 through 5, there is illustrated in perspective, top, front and side views, respectively, guard device 10 having disposed therein a central recess extending from the top to the bottom of said guard device 10, the recess having disposed about the perimeter thereof at the top thereof four flanges extending laterally away from the recess. Thus flanges 25, 26, 27 and 28 are provided circumscribing the recess 20. Flanges 25, 26 and 28 have disposed thereupon channel portions or raised portions 26*a*, 25*a*, 25*b* and 28*a*, respectively, whereupon the bottom side as best seen in FIGS. 4 and 5 are disposed channels which cooperate with the channels 51, 61, 62, and 41 disposed upon the outward walls of the opening 20, the walls being 30, 40, 50 and 60 and the bottom of said recess being 15. Thus as best illustrated in FIG. 2, these channels or air passages when viewed in conjunction with FIG. 1A provide means for air to pass through and around the guard device into the environment being heated while containing the contaminants which might be deposited within the recess 20 of said guard device.

In the preferred embodiment, the guard device is manufactured from a singular sheet of thermoplastic material by conventional methods. By manufacturing the guard device from plastic materials, the channel portions may be designed as best suited for the application at hand. As is apparent from the drawings, the choice of disposing the channel portions is a mere matter of selection and is not intended to limit the scope or application of alternative embodiments of the invention. Conceivably one channel portion may be disposed upon each of the flanges or upon two of the flanges, depending upon the heating requirements of the environment being heated and the ambient temperature of the outside air during the winter periods. Thus, in order to save money when heating a home within a zone having an average winter temperature of 40° (F.), one need not provide the same number of channels as when one is heating a home which is located within a zone having an ambient winter temperature of −10° (F.).

It is intended that the invention may be embodied and manufactured from aluminum or other metal products by conventional stamping methods or manufacturing methods known within the state of the art of metal manufacturing without departing from the scope of this invention. There is no intention to limit the scope of this intention to merely the preferred embodiment manufacture from thermoplastic materials. It is conceivable that a paper product if manufactured from a sufficiently rigid material would solve the problem although the paper may be required to be wax impregnated in order to be moisture proof.

As many changes can be made to the preferred embodiments of the invention without departing from the scope of the invention, it is intended that all matter contained herein by interpreted as illustrative of the invention and not in a limiting sense.

The embodiments of the invention in which an exclusive property or privilege is claimed are as follows:

1. Guard means comprising a top and bottom having disposed within the top thereof and extending towards the bottom thereof at least one recess, said at least one recess having side walls extending from proximate the top to proximate the bottom of the guard means, said side walls abutting at least one lateral flange proximate the top of said guard means, each lateral flange extending laterally away from the at least one recess proximate the top of said guard means, some of said side walls having disposed therein at least one channel means, each channel means extending from the bottom of said guard means to proximate the top of said guard means and thereat each channel continuing along the extension of a complimentary adjoining laterally extending flange whereat said channel terminates remote said recess; wherein when said guard means is inserted within an inlet or outlet of a ducting system, any contaminants will be prevented from entering said system, but the circulation of air or alternative gasses will be allowed through said channel means disposed within the side walls and flanges of said guard means.

2. The guard means of claim 1 wherein the side walls of the guard means comprise tapered side walls tapering from proximate the top of said guard means towards one another proximate the bottom of said guard means.

3. The guard means of claim 1 wherein the guard means is formed from a singular sheet of thermoplastic material by conventional moulding techniques.

4. The guard means of claim 2 wherein the guard means is formed from a singular sheet of thermoplastic material by conventional moulding techniques.

5. Guard means for use within a central heating system duct work of a house, said guard means comprising a top and bottom and being of substantially rectangular form, said guard means having disposed within the top thereof at least one recess extending from proximate the top of said guard means to proximate the bottom of said guard means, said recess having disposed therein about the perimeter thereof side walls, each side wall extending from proximate the top to proximate the bottom of said guard means, said at least one recess having disposed at the top thereof and extending laterally away therefrom at least one flange, said flange and its complimentary abutting side wall having disposed about the extremity thereof remote said recess, channel means extending from the bottom of said guard means at some of the sides thereof toward the top of said guard means, said channel then extending along the extension of each complimentary abutting flange and terminating approximate the end of each appropriate flange remote said recess, wherein when said guard means is inserted within the duct work of a central heating system, said guard means prevents the passage of contaminants or moisture to said duct system yet allowing the heated air to pass through the channel means to the environment of the house being heated.

6. The guard means of claim 5, wherein the side walls of the guard means comprise tapered side walls tapering from proximate the top of said guard means towards one another proximate the bottom of said guard means.

7. The guard means of claim 5 wherein the guard means is formed from a singular sheet of thermoplastic material by conventional moulding techniques.

* * * * *